United States Patent [19]

Uchiyama et al.

[11] Patent Number: 4,839,964

[45] Date of Patent: Jun. 20, 1989

[54] FIXING STRUCTURE OF BLADE FORCE UP SPRING FOR CLOTHES SHAVER AND ELECTRIC SHAVER

[75] Inventors: Hiromi Uchiyama; Tsuyoshi Nakano, both of Matsumoto, Japan

[73] Assignee: Izumi Seimitsu Kogyo Kabushiki Kaisha, Matsumoto, Japan

[21] Appl. No.: 96,878

[22] Filed: Sep. 15, 1987

[30] Foreign Application Priority Data

Jun. 27, 1987 [JP] Japan ..... 62-099105[U]

[51] Int. Cl.[4] ..... B26B 19/14

[52] U.S. Cl. ..... 30/43.6; 30/43.5

[58] Field of Search ..... 30/41, 41.5, 41.6, 38, 30/43.4, 43.5, 43.6, 346.51

[56] References Cited

U.S. PATENT DOCUMENTS

| | | | |
|---|---|---|---|
| 4,192,065 | 3/1980 | Tietjens | 30/43.6 |
| 4,318,223 | 3/1982 | Bergsma et al. | 30/43.6 |
| 4,343,086 | 8/1982 | de Vries et al. | 30/43.6 |
| 4,413,410 | 11/1983 | Otsuka et al. | 30/43.6 |

FOREIGN PATENT DOCUMENTS

| | | | |
|---|---|---|---|
| 0043554 | 4/1977 | Japan | 30/43.6 |
| 0070653 | 6/1977 | Japan | 30/43.6 |
| 0036360 | 4/1978 | Japan | 30/43.6 |
| 0083866 | 7/1978 | Japan | 30/43.6 |

*Primary Examiner*—Eugene R. Laroche
*Assistant Examiner*—Seung Ham
*Attorney, Agent, or Firm*—Jordan and Hamburg

[57] ABSTRACT

In a clothes shaver or an electric shaver having an outer blade including mesh, inner blades which are energized to the direction of the outer blade in a state of standing by a blade force up spring, and a fan which is fit to a rotary shaft of an inner blade supporting base and is possible to rotate with the inner blade supporting base, when fixing the fan of the blade force up spring is pressed to the bottom face of the inner blade supporting base by an end face of the fan which faces to the bottom face of the inner blade supporting base to fix on the bottom face thereof in one action.

5 Claims, 5 Drawing Sheets

FIXING STRUCTURE OF BLADE FORCE UP SPRING FOR CLOTHES SHAVER AND ELECTRIC SHAVER

BACKGROUND OF THE INVENTION AND RELATED ART STATEMENT

This invention relates to fixing structure of blade force up spring for clothes shaver and electric shaver.

Clothes shavers remove pills formed on a surface of clothes and electric shavers cut whiskers by an outer blade being formed as a mesh and inner blades rotating, and they discharge the pills or whiskers cut to the discharge section in the body proper by means of a fan rotating with the inner blades.

Fixing structure of blade force up spring for conventional clothes shaver which presses inner blades in the direction of the outer blade will be described by reference to FIGS. 8–10.

Inner blades 100 are inserted at their lower sections into slots 104 bored through an inner blade supporting base 102 and in which the inner blades 100 are movable. The number of the slots is as same as the number of the inner blades. The inner blades 100 are always forced upward to keep their standing state relative to the inner blade supporting base 102 by a blade force up spring 106.

A rotary shaft 112 provided vertically on the bottom of the inner blade supporting base 102 is fit into the center hole 108 of the blade force up spring 106 and bosses 116 provided at the bottom of the inner blade supporting base 102 are fit into the boss holes 114 thereof. Then, as shown in FIG. 10, the blade force up spring 106 is fixed to the bottom 110 of the inner blade supporting base 102 by crushing the heads of bosses 116. Fan 118 is press fitted on the outer face of the rotary shaft 112 to rotate together with the inner blade supporting base 102.

The above stated conventional fixing structure of the blade force up spring and the fan, however, has the following problem. The structure is formed by the steps of:

fitting the rotary shaft 112 of the inner blade supporting base 102 into the center hole 108 of the blade force up spring 106;

fixing the blade force up spring 106 by crushing the heads of the bosses 116; and fixing the fan on the outer face of the rotary shaft 112 by press fit.

So fixing the blade force up spring 106 and the fan 118, respectively, on the outer face of the rotary shaft 112 is very troublesome to execute.

SUMMARY OF THE INVENTION

The object of this invention is to provide fixing structure of blade force up spring for clothes shaver and electric shaver such that both the blade force up spring and the fan can be fixed in one action.

According to this invention, by pressing portions of the blade force up spring by the bottom face of the inner blade supporting base and the end face of the fan facing the bottom face of the inner blade supporting base to fix the blade force up spring at the inner blade supporting base, it is possible to fix the blade force up spring at the inner blade supporting base simulteneously when fixing the fan thereat. Therefore the prior two steps of fixing the blade force up spring and fixing the fan can be reduced to one step, so that manufacturing efficiency can be increased and manufacturing cost can be reduced.

BRIEF DESCRIPTION OF THE DRAWINGS

This invention is illustrated diagrammatically in the following drawings wherein.

DETAILED DESCRIPTION OF PREFERRED EMBODIMENTS

Detailed description of prefered embodiments will be described by reference to the drawings as follows.

Figure 1:
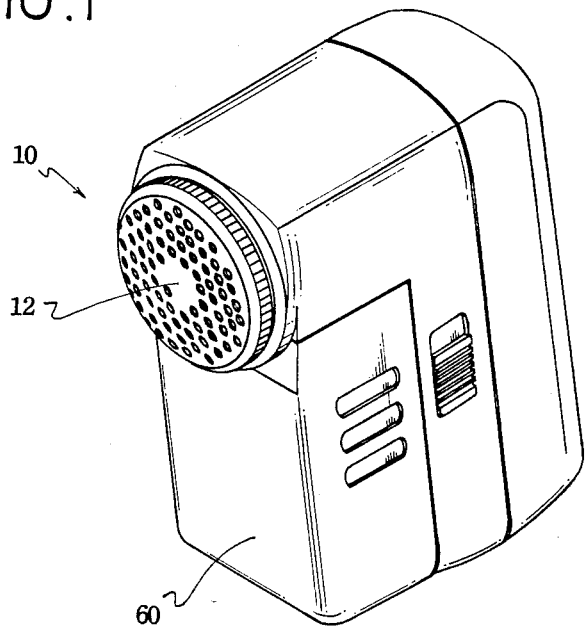
FIGS. 1 and 2 are perspective views of the clothes shaver.
Figure 2:
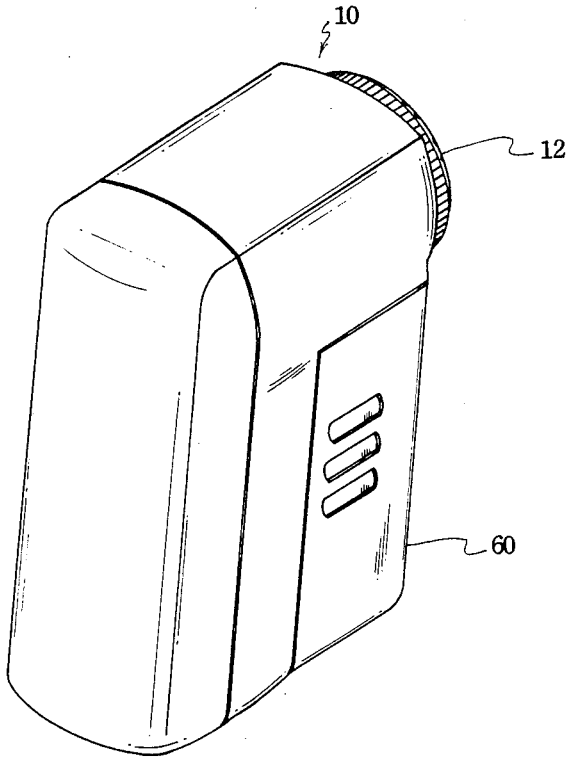

First, FIGS. 1 and 2 show appearance of the clothes shaver. There is provided a cutter section 10 and an outer blade having mesh thereat. The size of the mesh is sufficient for pills forming on a face of clothes to get into the outer blade. Inside the cutter section 10, there are provided inner blades (not shown in FIGS. 1 and 2).

Figure 3:
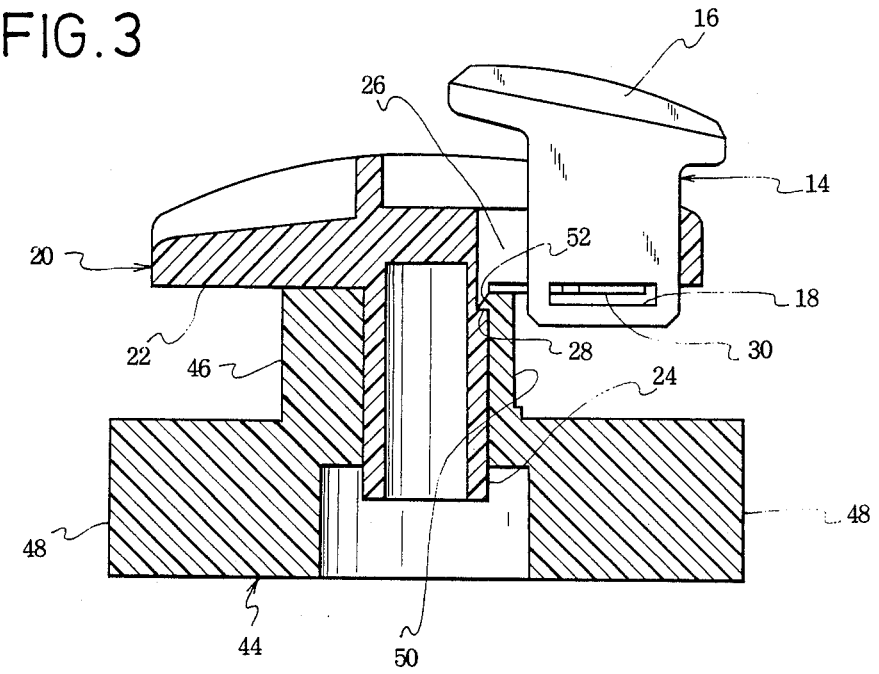
FIG. 3 is a typical sectional view of the vicinity of the inner blade of this invention.

In FIG. 3, at the end of the inner blade 14, there is formed a cutting section 16. In this embodiment, for example, three inner blades 14 are provided at regular intervals. There is formed a slot 18 at the lower part of the inner blade 14.

There is provided a rotary shaft 24 perpendicular on a bottom face 22 of an inner blade supporting base 20. The rotary shaft 24 is hollow and is connectable an output shaft of a motor (not shown) fixed in the clothes shaver proper. On the inner blade supporting base 20, three slots 26 open at regular internals in the radial direction to locate the inner blades 14, and the lower parts of the inner blades 14 are inserted into the slots 26 movably in which the inner blades 14 are movable. On the outer face of the rotary shaft 24 provided on the bottom face 22 of the inner blade supporting base 20, there are provided at regular intervals three steps 28 to engage a fan described later.

Figure 5:
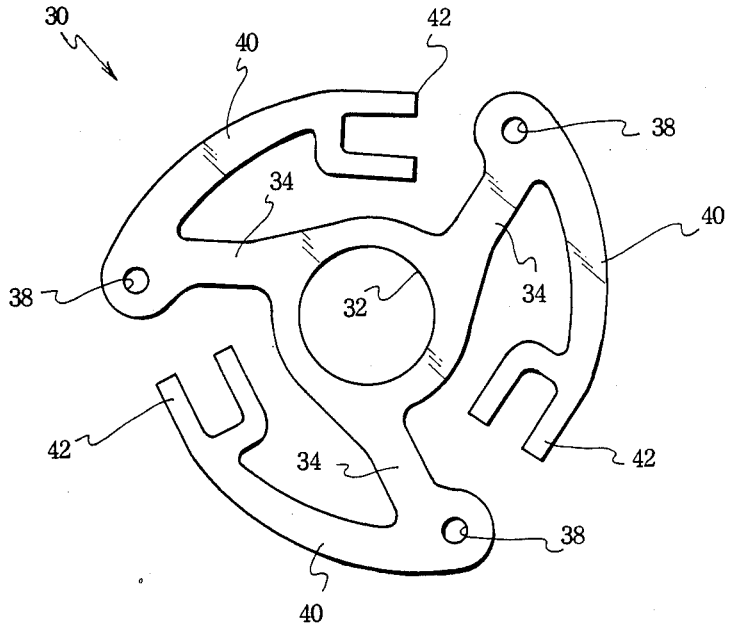
FIG. 5 is a plan view of the blade force up spring.
Figure 6:
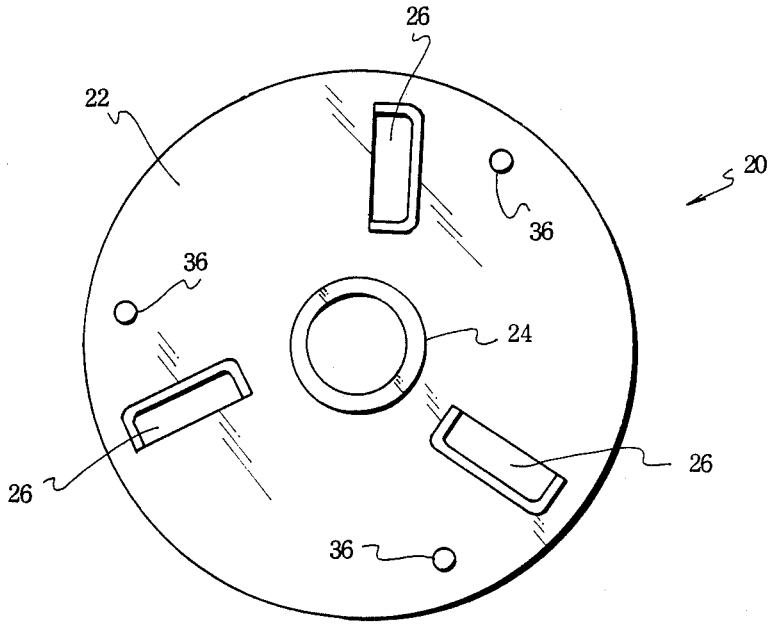
FIG. 6 is a bottom view of the inner blade supporting base of this invention.

A blade force up spring 30 is shown in FIG. 5 in detail. The blade force up spring 30 is made of elastic metal. In the middle thereof, center hole 32 is bored and the rotary shaft 24 provided on the bottom face 22 of the inner blade supporting base 20 (see FIG. 6) can be fit into the center hole 32. Three arms 34 extend from the center section is approximately radial directions, and at the front end sections of the arms 34, there are bored boss holes 38, into which bosses 36 projecting from the bottom face 22 of the inner blade supporting base 20 (see FIG. 6) can be fit. From the front end sections of arms 34, arms 40 extend clockwise.

At the front ends of the arms 40, force up sections 42 are formed like forks. To fix the blade force up spring 30 on the bottom face 22 of the inner blade supporting base 20 shown in FIG. 6, the rotary shaft 24 of the inner blade supporting base 20 is fit into the center hole 32 of the blade force up spring 30 and bosses 36 of the inner blade supporting base 20 are received in the boss holes 38 of the blade force up spring 30 for positioning. The force up sections 42 of the blade force up spring 30 are inserted into the slots 18 of the inner blades 14 which are inserted into the slots 26 of the inner blade supporting base 20.

Note that, when the blade force up spring 30 is fixed on the bottom face 22 of the inner blade supporting base 20, the force up sections 42 of the blade force up spring 30 keep the inner blades 14 standing in the slots 26 of the inner blade supporting base 20.

Figure 7:
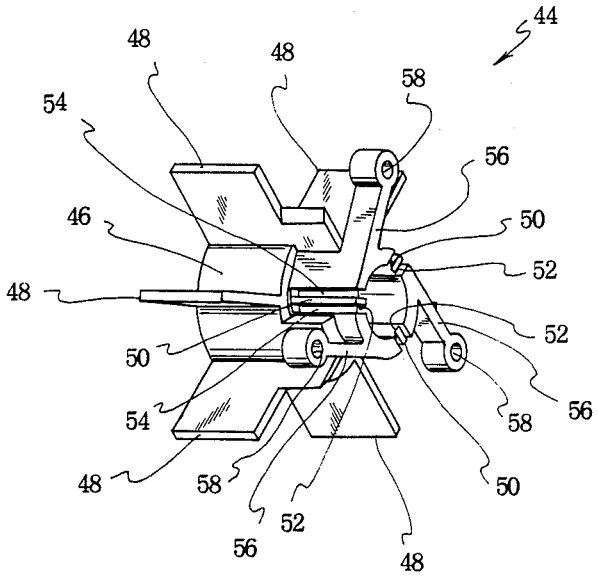
FIG. 7 is a perspective view of the fan of this invention.
Figure 8:
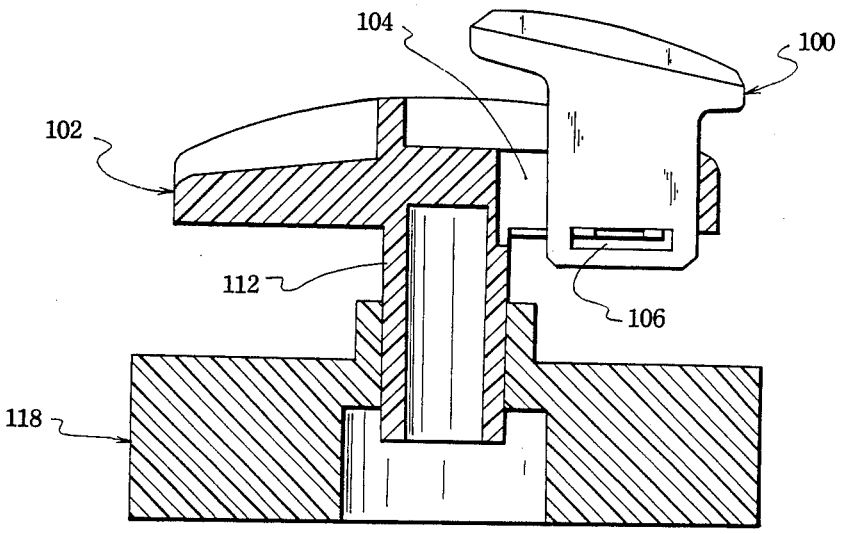
FIG. 8 Prior Art
FIG. 8 is a typical sectional view of vicinity of the inner blade of conventional one.
Figure 9:
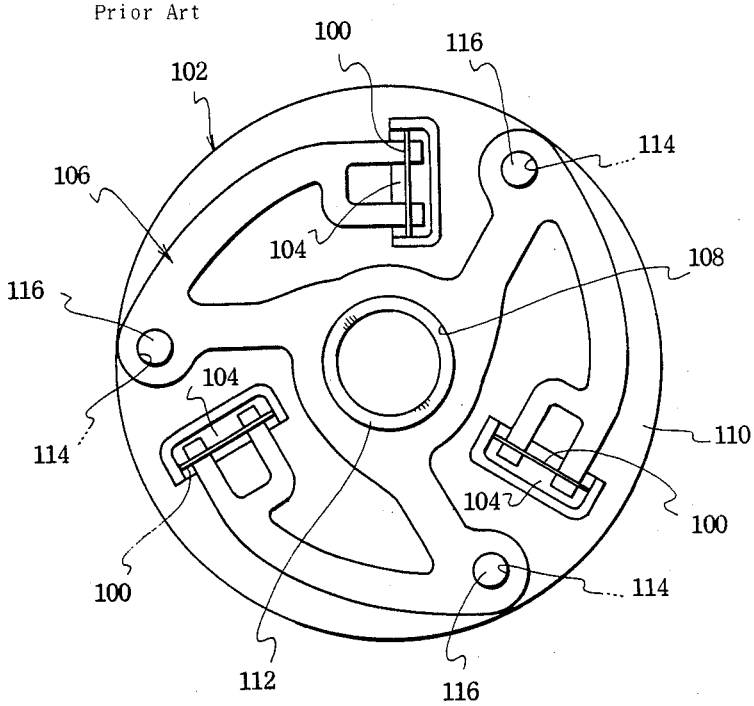
FIG. 9 Prior Art
FIG. 9 is a bottom view of conventional inner blade supporting base without fan.
Figure 10:
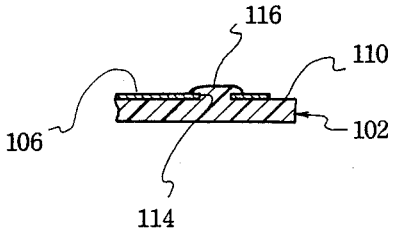
FIG. 10 Prior Art
FIG. 10 is a partial sectional view of conventional fixing structure of the blade force up spring to the inner blade supporting base.

Fan 44 are shown in FIG. 7.

Fan 44 is made of elastic resin. There are provided at regular intervals six radially extending fins 48 on the outer face of the shaft section 46 of the fan 44. The shaft section 46 of the fan 44 is hollow and is dimensioned to be received on the rotary shaft 24 of the inner blade supporting base 20.

At one end of the shaft section 46 of the fan 44, there are formed three hooks 50 at regular intervals. At the ends of the hooks 50, there are formed claws 52. When the fan 44 is received on the rotary shaft 24 to be fixed, the claws 52 of the hooks 50 engage the steps 28 of the rotary shaft 24. At both sides of each hook 50, there are cut parallel slits in the axial direction of shaft section 46 of the fan 44 for easier elastic deformation of the hooks 50. At the outer end of the shaft section 46 of the fan 44, three arms 56 extend approximately radially at regular intervals. At the front ends of the arms 56, there are bored base holes 58 into which the bosses 36 of the inner blade supporting base 20 ft.

Next, the method of fixing the fan 44 to the inner blade supporting base 20 will be described.

First, fitting the shaft section 46 of the fan 44 onto the rotary shaft 24 of the inner blade supporting base 20 on which the inner blades 20 and the blade force up spring 30 have been positioned.

When the rotary shaft 24 of the inner blade supporting base 20 is fit onto the shaft section 24 of the fan 44, hooks 50 of the fan 44 are deformed along the outer face of the rotary shaft 24 of the inner blade supporting base 20.

As, the rotary shaft 24 of the inner blade supporting base 20 is pressed further into the shaft section 46 of the fan 44, then claws 52 of the hooks 50 engage the steps 28 of the rotary shaft 24 and the hooks 50 which has deformed by their own elasticity return to their original forms. Catching the steps 28 of the rotary shaft 24 by the claws 52 of the hooks 50, the fan 44 can be prevented from slip-out from the rotary shaft 24 of the inner blade supporting base 20. At that time, the ends of the bosses 36 projected from the boss holes 38 of the blade force up spring 30 are fit into the boss holes 58 of the arms 56 of the fan 44 to fix the horizontal position of the fan 44 to the inner blade supporting base 20.

Figure 4:
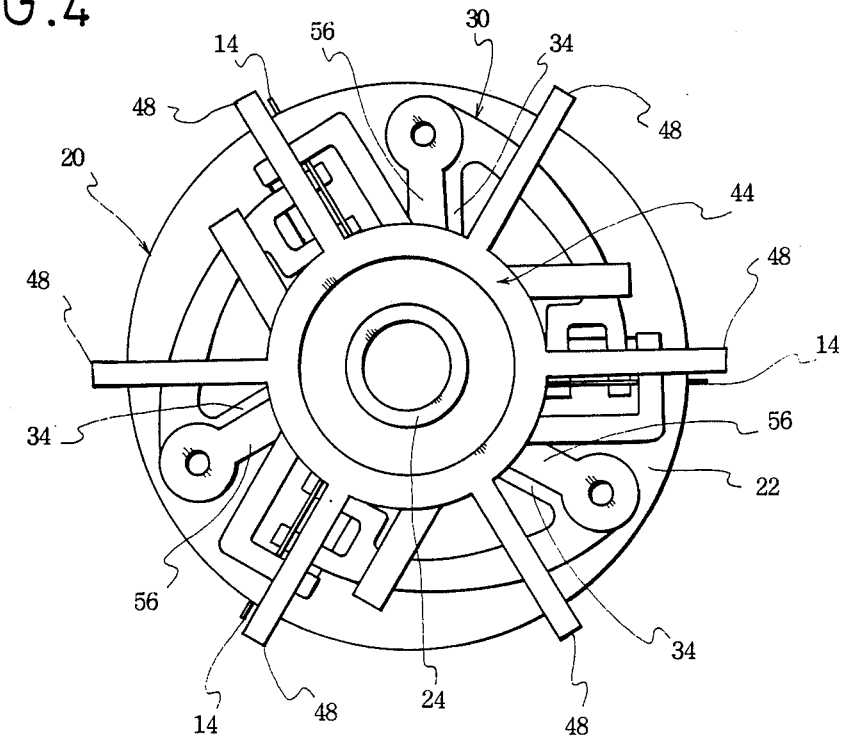
FIG. 4 is a bottom view of the inner blade supporting base with fan of this invention.

The state where the fan 44 is fixed to the inner blade supporting base 20 is shown in FIG. 4. When the fan 44 is fixed to the inner blade supporting base 20, top sections of the hooks 50 which face the bottom face 22 of the inner blade supporting base 20 press the portion of the blade force up spring 30 surrounding the center hole 32 of the blade force up spring 30 against the bottom face 22 of the inner blade supporting base 20 (see FIG. 3), and the upper faces of the arms 56 which face the bottom face 22 of the inner blade supporting base 20 press the arms 34 of the blade force up spring 30 against the bottom face 22 of the inner blade supporting base 20. By this pressing of the blade force up spring 30 against the inner blade supporting base 20, the blade force up spring 30 is perfectly fixed on the bottom face 22 of the inner blade supporting base 20, and the inner blades 14 can be mounted upright. Furthermore, the blade sections 16 of the inner blades 14 are kept projecting from the upper face of the inner blade supporting base 20, and if the inner blades 14 are pushed into the inner blade supporting base 20, the force up sections 42 of the inner blades 30 will make the inner blades 14 return to the original positions when the external force on the inner blades 14 is eliminated.

In the above stated structure, inner blades 14, the inner blade supporting base 20, the blade force up spring 30 and the fan 44 are assembled in one body, so when the rotary shaft 24 of the inner blade supporting base 20 is rotated by rotary force from a motor (not shown), the inner blades 14, the inner blade supporting base 20, the blade force up spring 30 and the fan 44 rotate together.

In such clothes shavers, pills on a material are introduced into the inside of the outer blade 12 through the mesh thereof, then they are cut by the rotating inner blades 14 and discharged to the discharge section 60 by the rotating fan 44.

In the above embodiment, the engaging of steps of the rotary shaft by hooks of the fan is disclosed as means for fixing the fan to the inner blade supporting base, but there are such other means as press fitting the rotary shaft onto to the shaft section of the fan, adhering, using pins, screwing, etc.

The above described structure of this invention can be adopted to electric shavers having a fan which discharges cut whiskers.

By this invention, fixing the blade force up spring and the fan to the inner blade supporting base are effected in one action so that efficiency of assembling clothes shavers or electric shavers can be increased.

The invention being thus described, it will be obvious that the same may be varied in many ways. Such variation are not to be regarded as a departure from the spirit and scope of the invention, and all such modification modifications as would be obvious to one skilled in the art are intended to be included within the scope of the following claims.

What is claimed is:

1. A rotary electric shaver for whiskers or clothing pills, comprising an outer blade in the form of a mesh, inner blades each having a cutting section at an extremity thereof, a base for supporting the inner blades with. the cutting sections thereof adjacent the outer blade, the base having an upper face facing the interior of the outer blade and a lower face, the base including a shaft projecting from the lower face thereof, a spring positioned on the lower face of the base for holding the inner blades upright in an orientation substantially vertical to the lower face with the cutting sections thereof adjacent the outer blade and for biasing the inner blades toward the outer blade, the spring having a central opening through which the base shaft projects, and a fan comprising a hollow shaft and blades projecting radially therefrom, the fan shaft being received on the base shaft with an axial extremity of the fan shaft pressing portions of the spring bordering the opening in the spring against the lower face of the base.

2. A rotary electric shaver according to claim 1, further comprising a plurality of steps formed in the base shaft and a like plurality of resilient hooks formed on the fan shaft, the hooks engaging the steps.

3. A rotary electric shaver according to claim 2, in which the hooks each have a face at said extremity of the fan shaft, said hook faces pressing said portions of the spring against the lower face of the base while said hooks are engaged in said steps.

4. A rotary electric shaver according to claim 3, in which the fan further comprises a plurality of arms extending substantially radially of the fan shaft, said arms each having a face at said extremity of the fan shaft, said arm faces pressing the spring against the lower face of the base.

5. A rotary electric shaver according to claim 4, further comprising a plurality of bosses formed on the base lower face equal in number to the plurality of arms, a like plurality of apertures in the spring through which the bosses fit, and an opening at a radial extremity of each of the arms in which a respective one of each of the bosses fits after passing through the apertures in the spring.

* * * * *